US011333398B2

(12) United States Patent
Monfared et al.

(10) Patent No.: US 11,333,398 B2
(45) Date of Patent: May 17, 2022

(54) BAFFLES FOR THERMAL TRANSFER DEVICES

(71) Applicant: Rheem Manufacturing Company, Atlanta, GA (US)

(72) Inventors: Amin Monfared, Oxnard, CA (US); Bruce Hotton, Seven Fields, PA (US); Lee Chambers, Santa Paula, CA (US); Babak Bagheri, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 203 days.

(21) Appl. No.: 16/725,844

(22) Filed: Dec. 23, 2019

(65) Prior Publication Data

US 2021/0190375 A1 Jun. 24, 2021

(51) Int. Cl.

| | |
|---|---|
| ***F28D 7/16*** | (2006.01) |
| ***F24H 9/00*** | (2022.01) |
| ***F22B 37/06*** | (2006.01) |
| ***F28F 13/06*** | (2006.01) |
| ***F28F 9/013*** | (2006.01) |
| *F28D 21/00* | (2006.01) |
| *F28F 9/22* | (2006.01) |

(52) U.S. Cl.

CPC ..... *F24H 9/0015* (2013.01); *F22B 37/06* (2013.01); *F28D 7/163* (2013.01); *F28F 9/0131* (2013.01); *F28F 13/06* (2013.01); *F28D 7/16* (2013.01); *F28D 21/0003* (2013.01); *F28F 2009/222* (2013.01)

(58) Field of Classification Search

CPC ..... F28F 9/028; F28F 9/0265; F28F 9/0212; F28F 9/0209; F28F 13/06; F24H 9/0015; F24H 1/205; F24H 1/287; F24H 1/34; F24H 1/346

See application file for complete search history.

(56) References Cited

U.S. PATENT DOCUMENTS

| | | | | |
|---|---|---|---|---|
| 2,423,697 A * | 7/1947 | Garfield | F28D 7/12 29/890.036 |
| 6,142,215 A * | 11/2000 | Paulsen | F28D 1/0213 165/128 |
| 6,827,138 B1 * | 12/2004 | Master | F28F 9/22 165/159 |
| 2008/0190593 A1 * | 8/2008 | Wang | F28F 9/22 165/159 |

(Continued)

FOREIGN PATENT DOCUMENTS

| | | | |
|---|---|---|---|
| EP | 3356747 A1 * | 8/2018 | F24H 1/287 |
| WO | WO-2019168225 A1 * | 9/2019 | F24H 9/1836 |

*Primary Examiner* — Devon Russell

(74) *Attorney, Agent, or Firm* — Troutman Pepper Hamilton Sanders LLP

(57) ABSTRACT

A baffle for a fluid collection portion of a thermal transfer device can include a body having an inner perimeter, an outer perimeter, and an asymmetric feature, where the asymmetric feature is configured to create a pressure drop within the fluid collection portion of the thermal transfer device. The inner perimeter can be configured to be at least as large as an inner surface of a first wall that forms the fluid collection portion of the thermal transfer device. The outer perimeter can be configured to be no larger than an outer surface of a second wall that forms the fluid collection portion of the thermal transfer device.

19 Claims, 11 Drawing Sheets

(56) References Cited

U.S. PATENT DOCUMENTS

| | | | | |
|---|---|---|---|---|
| 2012/0080172 | A1* | 4/2012 | Pacholski | F24H 9/0015 165/157 |
| 2016/0018168 | A1* | 1/2016 | Urbanski | F28D 7/16 165/159 |
| 2017/0045310 | A1* | 2/2017 | Choi | F24H 1/36 |

* cited by examiner

BAFFLES FOR THERMAL TRANSFER DEVICES

TECHNICAL FIELD

Embodiments described herein relate generally to thermal transfer devices, and more particularly to baffles for thermal transfer devices.

BACKGROUND

Heat exchangers, boilers, combustion chambers, water heaters, and other similar thermal transfer devices control or alter thermal properties of one or more fluids. In some cases, two tube sheets are disposed within these devices to hold one or more tubes (e.g., heat exchanger tubes, condenser tubes) in place. A fluid, typically water, flows within these thermal transfer devices around heat exchanger tubes, the ends of which are held in place by the tube sheets. As the fluid heats within the thermal transfer device, the fluid can pass through multiple chambers before leaving the thermal transfer device.

SUMMARY

In general, in one aspect, the disclosure relates to baffle for a fluid collection portion of a thermal transfer device. The baffle can include a body having an inner perimeter, an outer perimeter, and an asymmetric feature, where the asymmetric feature is configured to create a pressure drop within the fluid collection portion of the thermal transfer device. The inner perimeter can be configured to be at least as large as an outer surface of a first wall that forms the fluid collection portion of the thermal transfer device. The outer perimeter can be configured to be no larger than an inner surface of a second wall that forms the fluid collection portion of the thermal transfer device.

In another aspect, the disclosure can generally relate to fluid collection portion of a thermal transfer device. The fluid collection device can include a first wall having an outer surface and a second wall having an inner surface. The fluid collection device can also include an outlet and a first baffle disposed between the first wall and the second wall, wherein the first baffle having a first baffle body having a first inner perimeter, a first outer perimeter, and a first asymmetric feature, where the first asymmetric feature is configured to create a pressure drop within the fluid collection portion of the thermal transfer device, where the pressure drop forces fluid proximate to the first baffle to traverse toward the outlet.

These and other aspects, objects, features, and embodiments will be apparent from the following description and the appended claims.

BRIEF DESCRIPTION OF THE DRAWINGS

The drawings illustrate only example embodiments of baffles for thermal transfer devices and are therefore not to be considered limiting of its scope, as baffles for thermal transfer devices may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
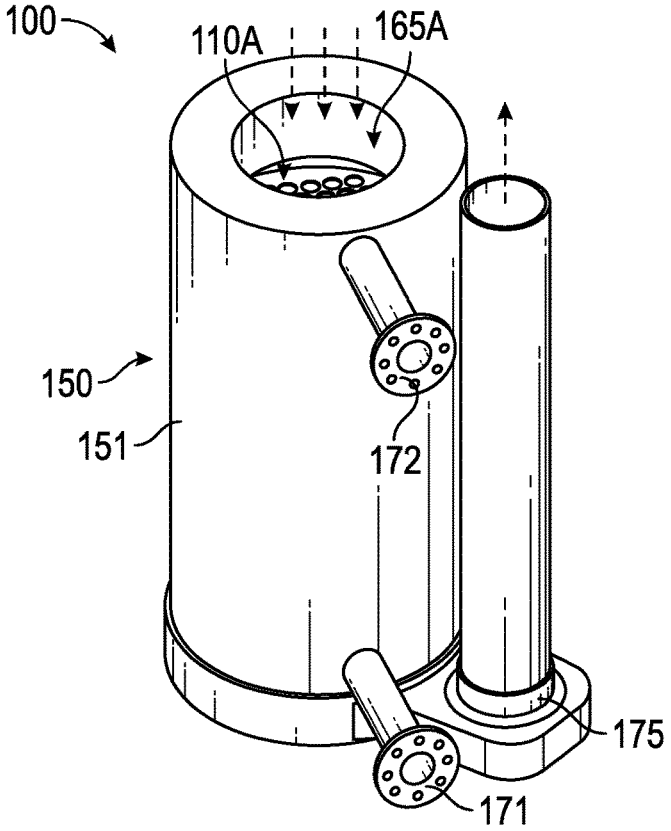
FIG. 1A (Prior Art)
FIGS. 1A and 1B show of a thermal transfer device currently used in the art.

The example embodiments discussed herein are directed to systems, methods, and devices for baffles (sometimes also called diffuser plates) for thermal transfer devices. Example embodiments can be directed to any of a number of thermal transfer devices, including but not limited to boilers, condensing boilers, heat exchangers, and water heaters. Further, one or more of any number of fluids can flow through and around the tubes (also called heat exchanger tubes or HX tubes herein) and through the example baffles disposed within these thermal transfer devices. Examples of such fluids can include, but are not limited to, water, steam, burned fuel (e.g., natural gas, propane) mixed with air, glycol, and dielectric fluids. As discussed further herein, in a boiler or water heater application, typically a heated gas flows within the HX tubes and water flows around the outside of the HX tubes and through the baffles located outside the HX tubes.

Example embodiments of baffles can be pre-fabricated or specifically generated (e.g., by shaping a malleable body) for a particular thermal transfer device. Example embodiments can have standard or customized features (e.g., shape, size, features on the inner surface, pattern, configuration). Therefore, example embodiments described herein should not be considered limited to creation or assembly at any particular location and/or by any particular person.

The example baffles (or components thereof) described herein can be made of one or more of a number of suitable materials and/or can be configured in any of a number of ways to regulate and/or control the flow of fluid flowing around the HX tubes with a heat transfer device in such a way as to meet certain standards and/or regulations while also maintaining reliability of the heat transfer device (including components thereof, such as the HX tubes), regardless of the one or more conditions under which the example baffles can be exposed. Examples of such materials can include, but are not limited to, aluminum, stainless steel, ceramic, fiberglass, glass, plastic, and rubber. In some cases, an example baffle can be coated with one of more materials.

As discussed above, example baffles (or vessels in which example baffles are disposed) can be subject to complying with one or more of a number of standards, codes, regulations, and/or other requirements established and maintained by one or more entities. Examples of such entities can include, but are not limited to, the American Society of Mechanical Engineers (ASME), American Society of Heating, Refrigeration and Air Conditioning Engineers (ASHRAE), Underwriters' Laboratories (UL), American National Standard Institute (ANSI), the National Electric Code (NEC), and the Institute of Electrical and Electronics Engineers (IEEE). An example baffle allows a vessel of a heat transfer device (e.g., boiler, heat exchanger) to continue complying with such standards, codes, regulations, and/or other requirements. In other words, an example baffle, when disposed within the vessel of such a heat transfer device, does not compromise compliance of the vessel with any applicable codes and/or standards.

Any example baffles, or portions thereof, described herein can be made from a single piece (e.g., as from a mold, injection mold, die cast, 3-D printing process, extrusion process, stamping process, or other prototype methods). In addition, or in the alternative, an example baffles (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with example baffles. Examples of a user may include, but are not limited to, an engineer, a maintenance technician, a mechanic, an employee, an operator, a consultant, a contractor, and a manufacturer's representative. Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example baffle to become coupled, directly or indirectly, to another portion of the baffle and/or another component of a heat transfer device. A coupling feature can include, but is not limited to, a snap, a clamp, a portion of a hinge, an aperture, a recessed area, a protrusion, a slot, a spring clip, a tab, a detent, and mating threads. One portion of an example baffle can be coupled to a vessel of a heat transfer device by the direct use of one or more coupling features.

In addition, or in the alternative, a portion of an example baffle can be coupled to a vessel using one or more independent devices that interact with one or more coupling features disposed on a coupling feature of the baffle. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. The numbering scheme for the components in the figures herein parallel the numbering scheme for the corresponding components described in another figure in that each corresponding component is a three-digit number having the identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of baffles for thermal transfer devices will be described more fully hereinafter with reference to the accompanying drawings, in which example embodiments of baffles for thermal transfer devices are shown. Baffles for thermal transfer devices may, however, be embodied in many different forms and should not be construed as limited to the example embodiments set forth herein. Rather, these example embodiments are provided so that this disclosure will be thorough and complete, and will fully convey the scope of baffles for thermal transfer devices to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "lower", and "upper" are used merely to distinguish one component (or part of a component or state of a component) from another. Such terms are not meant to denote a preference or a particular orientation. Such terms are not meant to limit embodiments of baffles for thermal transfer devices. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
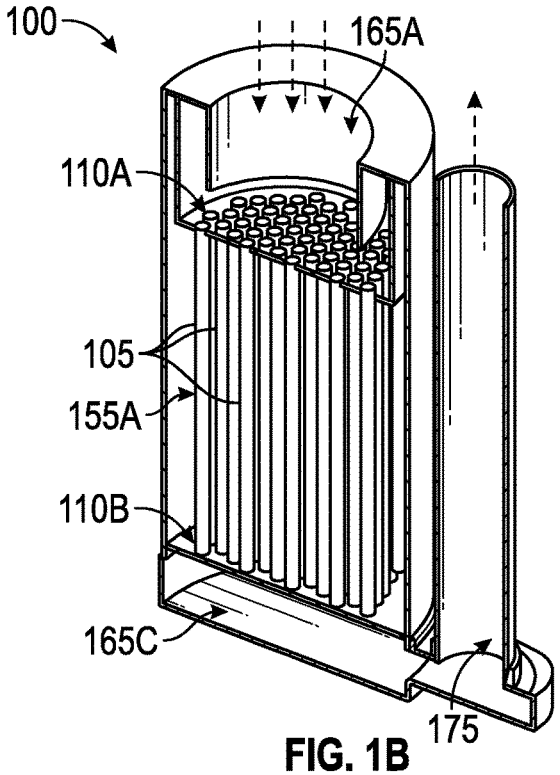
FIG. 1B (Prior Art)

FIGS. 1A and 1B show a thermal transfer device 100 currently used in the art. Specifically, FIG. 1A shows a perspective view of the thermal transfer device 100, and FIG. 1B shows a cross-sectional perspective view of the thermal transfer device 100. Referring to FIGS. 1A and 1B, the thermal transfer device 100 includes one or more of any number of components. For example, in this case, the thermal transfer device 100 includes at least one wall 151 that forms a cavity, which in this case is divided into a top flue gas portion 165A (also called the flue gas combustion chamber 165A), a main fluid portion 155A, and a bottom flue gas portion 165C (also called a flue gas collection chamber 165C). The flue gas collection chamber 165C provides a collection of flue gas for an exhaust vent 175. The thermal transfer device 100 in this case includes two tube sheets 110 (top tube sheet 110A and bottom tube sheet 110B). Tube sheet 110A separates the top flue gas portion 165C from the main fluid portion 155A, and tube sheet 110B separates the main fluid portion 155A from the flue gas collection chamber 165C. Tube sheet 110A and tube sheet 110B hold a number of HX tubes 105.

The thermal transfer device 100 uses a mixture of a combusted fuel (e.g., natural gas, propane, coal) and air to transfer heat to a fluid (e.g., water), and the heated fluid (e.g., water, steam) can be used for some other process or purpose. The mixture of the combusted fuel and air can be called flue gas. In some cases, the fuel can be premixed with some other component, such as air. For example, the fuel/air mixture can be introduced into the top flue gas portion 165A at the top of the thermal transfer device 100, as shown at the top of FIGS. 1A and 1B. Once inside the top flue gas portion 165A, there can be some heat source (e.g., a burner, an ignitor) that raises the temperature of the fuel/air mixture, resulting in combustion and burning of the fuel/air mixture.

From there, the resulting hot gases (byproducts of the combustion of the fuel/air mixture) can be directed into the various HX tubes 105 and travel down those HX tubes 105 to the flue gas collection chamber 165C. The HX tubes 105 are made of one or more of a number of thermally conductive materials (e.g., aluminum, stainless steel). In this way, the heat from the hot gases transfers to the HX tubes 105 as the hot fuel/air mixture travels toward the flue gas collection chamber 165C. Once reaching the flue gas collection chamber 165C, the hot gases then continue on to the exhaust vent 175 and leaves the thermal transfer device 100. The water vapor in the hot gases can either be in the vapor phase (non-condensing mode) or in the liquid phase (condensing mode), depending on the design of the thermal transfer device 100.

At the same time, another fluid (e.g., water) is brought into the bottom part of the main fluid portion 155A of the thermal transfer device 100 through the inlet 171. Once inside the main fluid portion 155A, the fluid comes into contact with the outer surfaces of the HX tubes 105. As discussed above, since the HX tubes 105 are made of a thermally conductive material, when the hot gases (from the combustion process) travel down the HX tubes 105, some of the heat from the fuel is transferred to the walls of the HX tubes 105. Consequently, as the fluid comes into contact with the outer surface of the thermally-conductive walls of the HX tubes 105 within the main fluid portion 155A, some of the heat captured by the walls of the tubes HX 105 from the heated fuel is further transferred to the fluid in the main fluid portion 155A. The heated fluid is drawn up toward the top of the main fluid portion 155A of the thermal transfer device 100. Once reaching the top of the main fluid portion 155A, the heated fluid is then drawn out of the thermal transfer device 100 through the outlet 172. The heated fluid can then be used for one or more other processes, such as space heating and hot water for use in a shower, a clothes washing machine, and/or a dishwashing machine.

The HX tubes 105 are held in place within the main fluid portion 155A of the thermal transfer device 100 by tube sheets 110. Specifically, one tube sheet 110A is disposed toward the top end of the main fluid portion 155A and secures one end of the HX tubes 105, while another tube sheet 110B is disposed toward the bottom end of the main fluid portion 155A and secures the opposite end of the HX tubes 105. The tube sheets 110 can be coupled to an interior surface (e.g., disposed in a recess of an inner surface of the wall 151) of the thermal transfer device 100.

As discussed above, the tube sheets 110 also set the bounds of the main fluid portion 155A in which the fluid flows. Specifically, the holes in the tube sheets 110 are configured to substantially perfectly accommodate the ends of the HX tubes 105, and the outer perimeter of the tube sheets 110 is configured to abut against the inner surface of the wall 151. In this way, none of the combusted fuel/air mixture intermingles with the fluid that is being heated at any point within the thermal transfer device 100. In other words, the fluid does not enter the top flue gas portion 165A and the bottom flue gas portion 165C, and the fuel/air mixture does not enter the main fluid portion 155A.

Figure 2A:
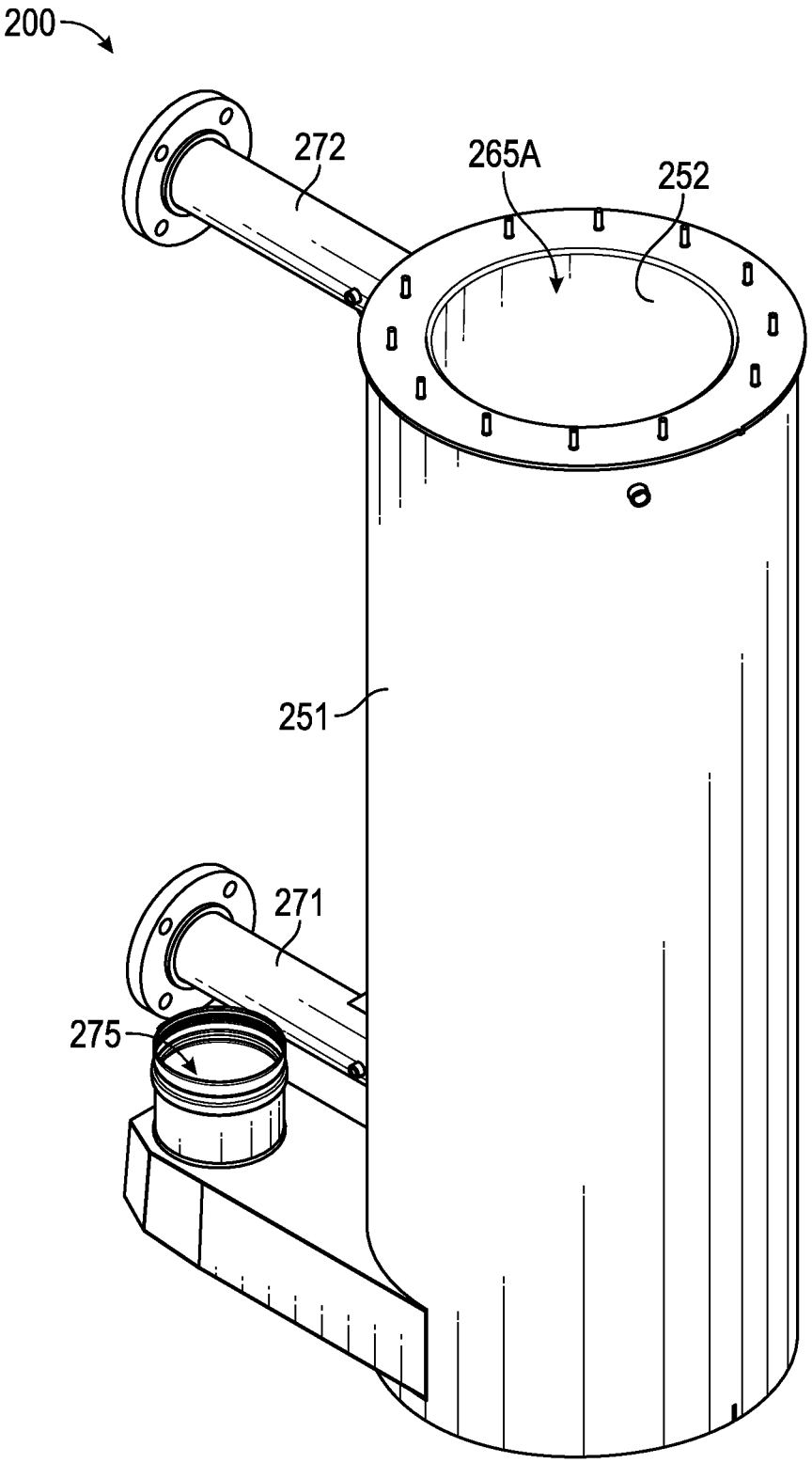
FIGS. 2A through 2D show various views of a thermal transfer device in accordance with certain example embodiments.
Figure 2B:
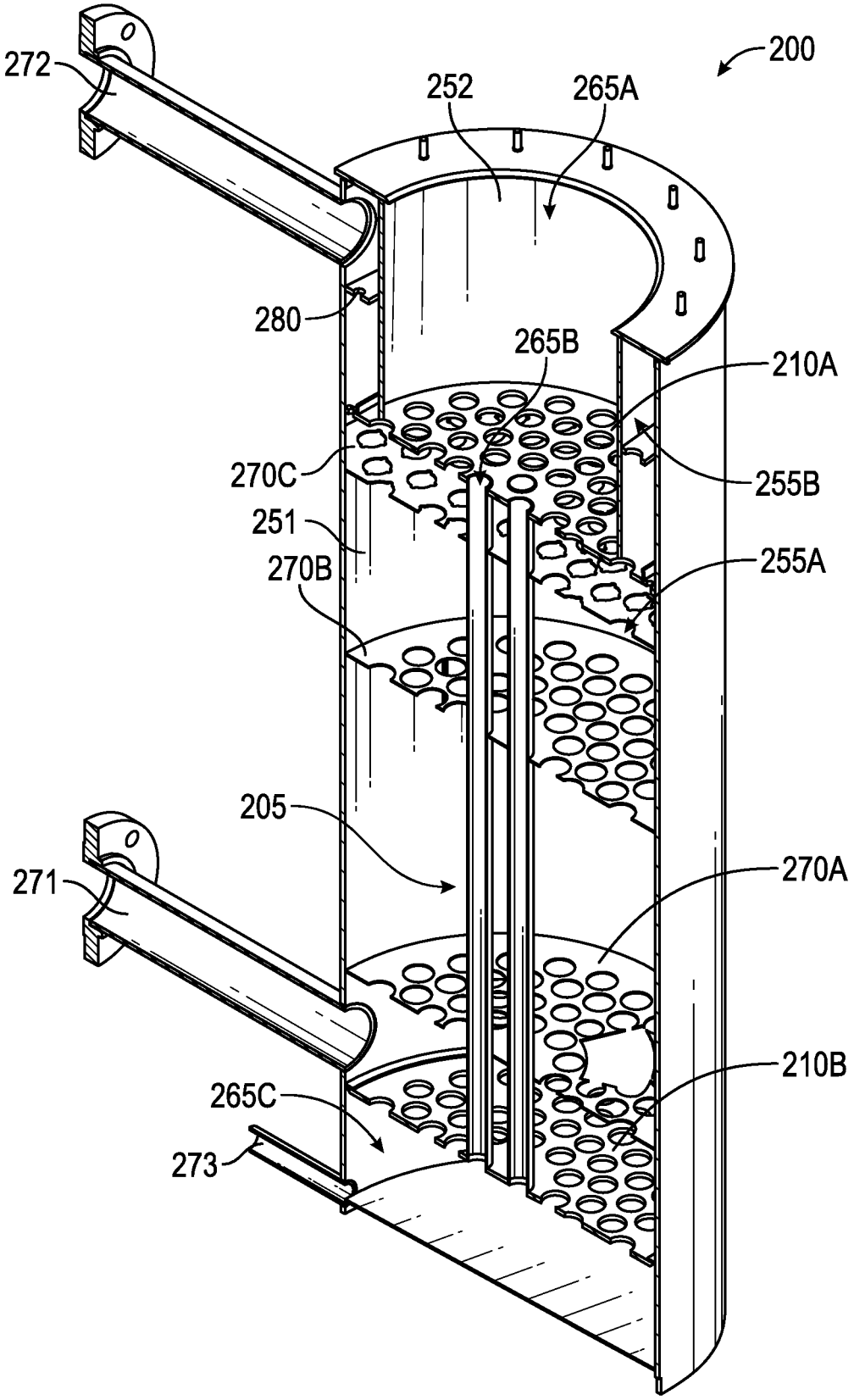
Figure 2C:
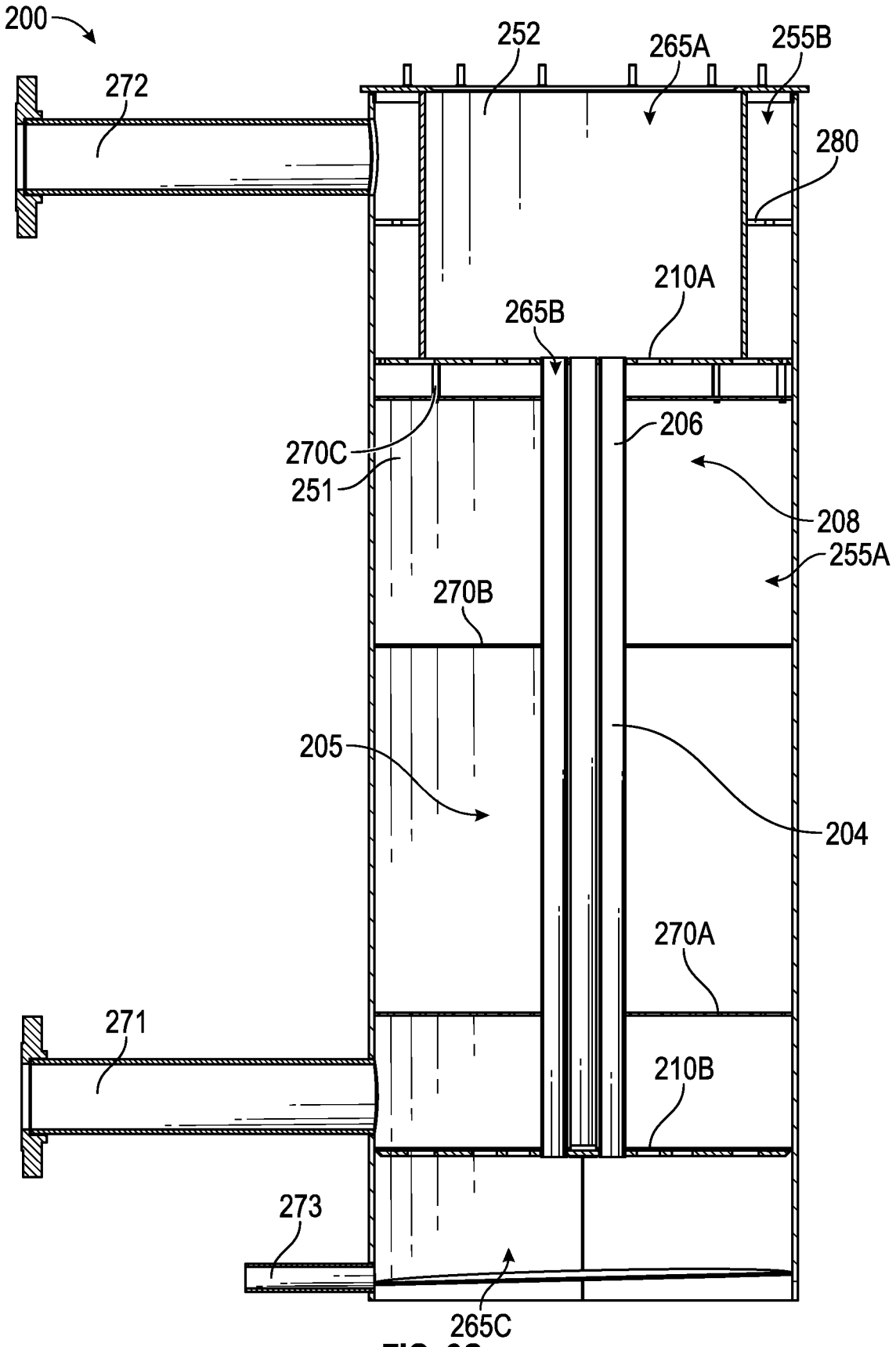
Figure 2D:
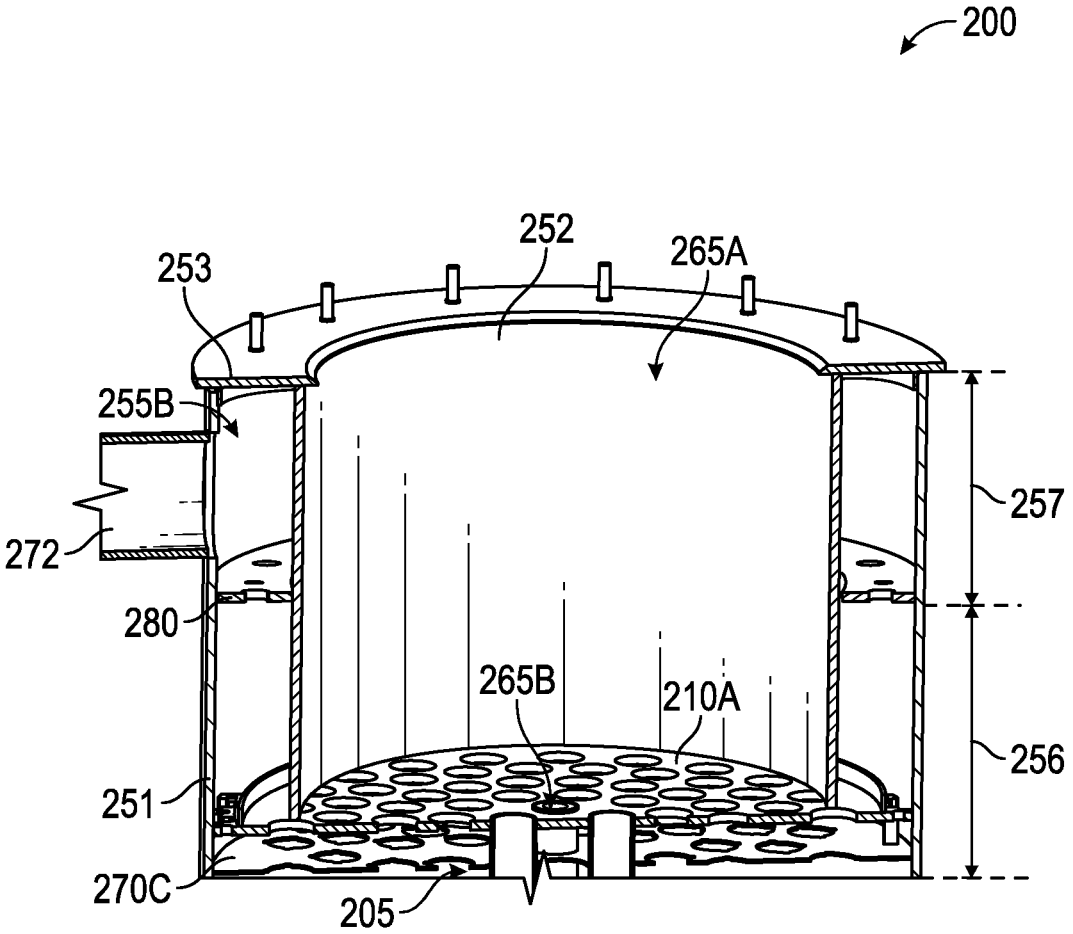

FIGS. 2A through 2D show various views of a thermal transfer device 200 in accordance with certain example embodiments. Specifically, FIG. 2A shows a front-side-top perspective view of the thermal transfer device 200. FIG. 2B shows a cross-sectional front-side-top perspective view of the thermal transfer device 200. FIG. 2C shows a cross-sectional side view of the thermal transfer device 200. FIG. 2D shows a detailed cross-sectional side view of the thermal transfer device 200.

Referring to FIGS. 1A through 2D, the thermal transfer device 200 has some similarities to the thermal transfer device 100 of FIGS. 1A and 1B. For example, the thermal transfer device 200 of FIGS. 2A through 2D includes at least one wall 251, inside of which are one or more portions of one or more cavities. Toward the bottom of the thermal transfer device 200 is a flue gas collection chamber 265C, (also called a bottom flue gas portion 265C herein) above which is located the HX tubes 205 and the main fluid portion 255A, above which is located the top flue gas portion 265A (also called a combustion chamber 265A). A tube sheet 210A separates the top flue gas portion 265A from the main fluid portion 255A, and another tube sheet 210B separates the bottom flue gas portion 265C from the main fluid portion 255A.

There are a number of HX tubes 205 disposed within the main fluid portion 255A and held in place by tube sheet 210A and tube sheet 210B. An exhaust vent 275 is connected to the bottom flue gas portion 265C by a pipe 273. There is also an inlet 271 that feeds fluid into the main fluid portion 255A of the thermal transfer device 200, and there is an outlet 272 that removes heated fluid from the thermal transfer device 200. All of these various components of the thermal transfer device 200 of FIGS. 2A through 2D can be substantially the same as the corresponding components of the thermal transfer device 100 of FIGS. 1A and 1B, except as described below.

Figure 4:
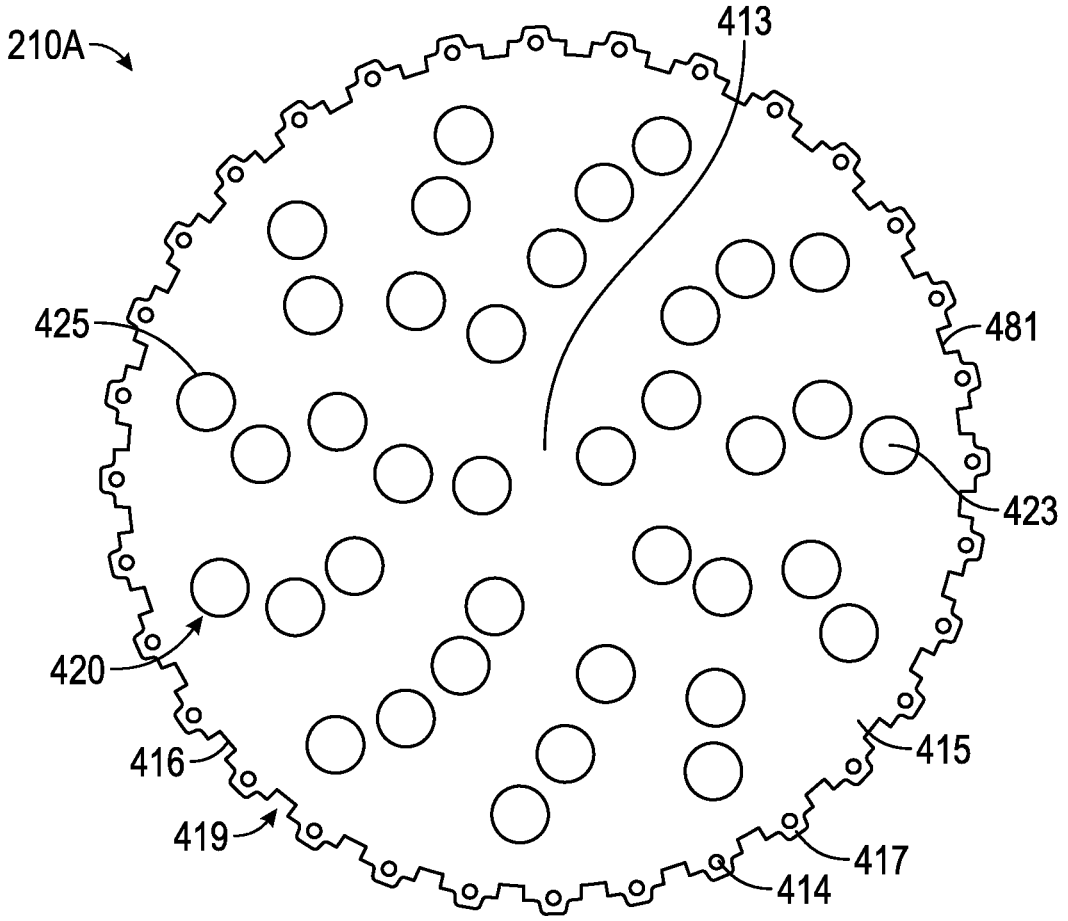
FIG. 4 shows top views of a tube sheet of FIGS. 2A through 2D.
Figure 5:
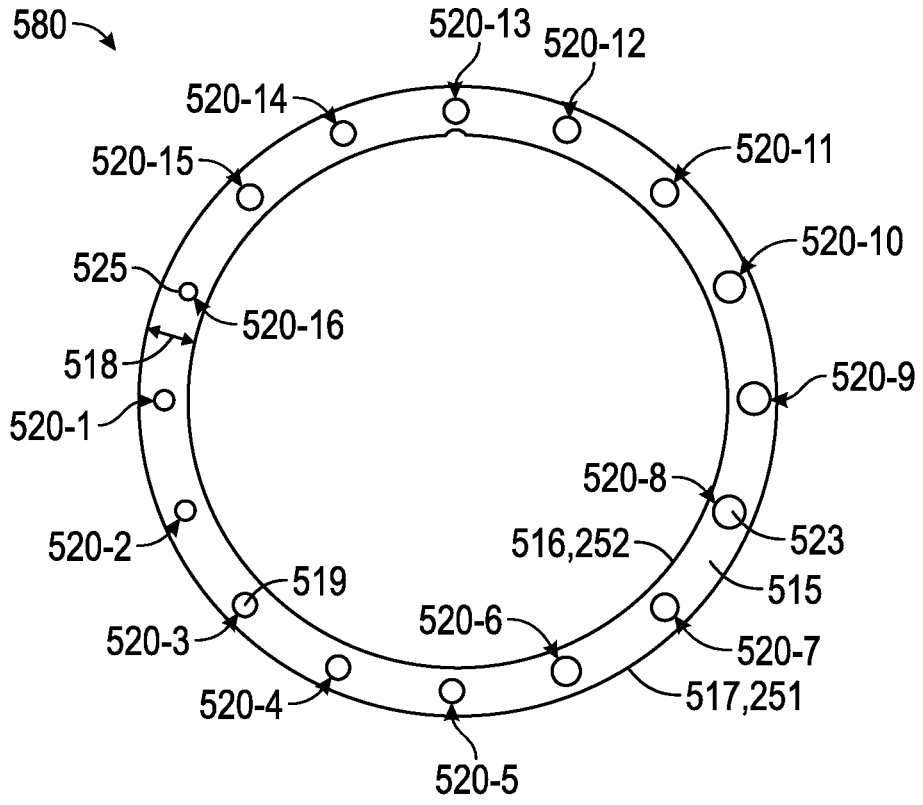
FIGS. 5 through 8 show a top view of baffles for use in the fluid collection portion of a thermal transfer device in accordance with certain example embodiments.

Tube sheet 210A is disposed near the top end of the HX tubes 205, and bottom tube sheet 210B is disposed near the bottom end of the HX tubes 205. In some cases, the top tube sheet 210A and the bottom tube sheet 210B are substantially identical to each other. Alternatively, as in this case, the top tube sheet 210A and the bottom tube sheet 210B are configured differently with respect to each other. A detailed view of tube sheet 210A is shown in FIG. 4 below, and a detailed view of tube sheet 210B is shown in FIG. 5 below.

The thermal transfer device 200 of FIGS. 2A through 2D can also include one or more optional baffles 270 (also sometimes called diffuser plates 270) disposed within the main fluid portion 255A between tube sheet 210A and tube sheet 210B. Each baffle 270 can serve one or more purposes. For example, a role of a baffle 270 can be to redirect the flow of fluid within the main fluid portion 255A. As another example, a baffle 270 can be used to make the flow of fluid within the main fluid portion 255A more uniform around the HX tubes 205. As yet another example, from a structural point of view, a baffle 270 can be used, in conjunction with tube sheets 210, to maintain the position of the HX tubes 205 within the main fluid portion 255A. An optional baffle 270 can have any of a number of configurations.

Above tube sheet 210A are the flue gas combustion chamber 265A and the fluid collection portion 255B, which are separated from each other by a wall 252 and the tube sheet 210A. Fluid continuity is formed between the fluid collection portion 255B and the main fluid portion 255A by a series of recessed features along the outer perimeter of tube sheet 210A, an example of which is shown in more detail in FIG. 4 below. The fluid collection portion 255B is designed to collect the fluid, heated while flowing through the main fluid portion 255A, and funnel the fluid toward the outlet 272.

In embodiments currently known in the art, the fluid collection portion 255B is often configured in such a way that fluid tends to collect in pockets (particularly at locations opposite the outlet 272) within the fluid collection portion 255B rather than flow toward the outlet 272. For example, as shown in FIGS. 2A through 2D, the inlet 271 and the outlet 272 are often positioned on the same side of the thermal transfer device 200 to increase the ease of installation, but this configuration tends to encourage fluid to build and stagnate in the area of the fluid collection portion 255B opposite the outlet 272. As a result, the fluid collection portion of thermal transfer devices currently known in the art tend to have high temperatures during operation, particularly at locations opposite the outlet, which leads to thermal cycle fatigue and subsequent failure of the thermal transfer devices.

Example embodiments are designed to greatly reduce or prevent the occurrence of thermal cycle fatigue within the fluid collection portion 255B of the thermal transfer device 200. Specifically, example embodiments have one or more baffles 280 that are disposed within the fluid collection portion 255B, thereby better channeling the fluid flowing into the fluid collection portion 255B toward the outlet 272 in a more direct and balanced flow through the fluid collection portion 255B. The example baffles 280 can have any of a number of configurations. Examples of baffles 280 are shown below with respect to FIGS. 5 through 8.

An example baffle 280 can be located at any point within the fluid collection portion 255B of the thermal transfer device 200. In the example shown in FIGS. 2A through 2D, the baffle 280 is disposed toward the middle (vertically) of the fluid collection portion 255B at a distance 256 above tube sheet 210A and a distance 257 below the top wall 253. In this case, distance 256 and distance 257 are approximately the same. As described below in more detail with respect to FIGS. 5 through 8, an example baffle 280 has at least one asymmetrical feature (e.g., spacing of apertures, size of apertures, distance between inner perimeter and outer perimeter, curvature to the body) along the baffle 280 that is used to create a pressure drop within the fluid collection portion 255B.

The optional baffles 280 can be located within the fluid collection portion 255B in one or more of a number of ways. For example, a baffle 280 can be coupled to the inner surface of the wall 251 and/or the outer surface of the wall 252 using one or more independent coupling features (e.g., welding, slots, compression fittings, brackets, fastening devices (e.g., bolt, rivet)). As another example, one or more brackets can be used to secure one or more baffles 280. As another example, and one or more coupling features (e.g., slots, protrusions, recesses, detents) disposed in the inner surface of the wall 251 and/or the outer surface of the wall 252 hold one or more baffles 280 in place within the fluid collection portion 255B. Any of these distances locating a baffle 270 within the fluid collection portion 255B can be adjusted to increase or maximize the benefits (e.g., more effective temperature distribution to eliminate "hot spots", more efficient flow of the fluid) of using one or more example baffles 280 in the thermal transfer device 200.

In some cases, to help solve the problem of improving the flow of fluid within the fluid collection portion 255B, the characteristics (e.g., the shape, the size) of the flue gas combustion chamber 265A can be modified. By modifying the characteristics of the flue gas combustion chamber 265A, the configuration of the wall 252 shared with the fluid collection portion 255B changes, thereby necessarily changing the characteristics of the fluid collection portion 255B. For example, the width of the flue gas combustion chamber 265A can be increased, which decreases the width, at least in one area of the fluid collection portion 255B.

The thermal transfer device 200 shows some, but not all, of the HX tubes 205. In this case, the HX tubes 205 can all be configured identically with respect to each other. Alternatively, one or more HX tubes 205 can be configured differently than one or more of the other HX tubes 205. In this example, each HX tube 205 has a fundamentally tubular and featureless outer surface 206, as shown at each end 208. The middle portion 203 of each HX tube 205 is disposed between the ends 208 and in this case also has a featureless outer surface 204. There is a continuous path inside the cavity 265B of each HX tube 205 along the entire length of the HX tube 205.

Figure 3A:
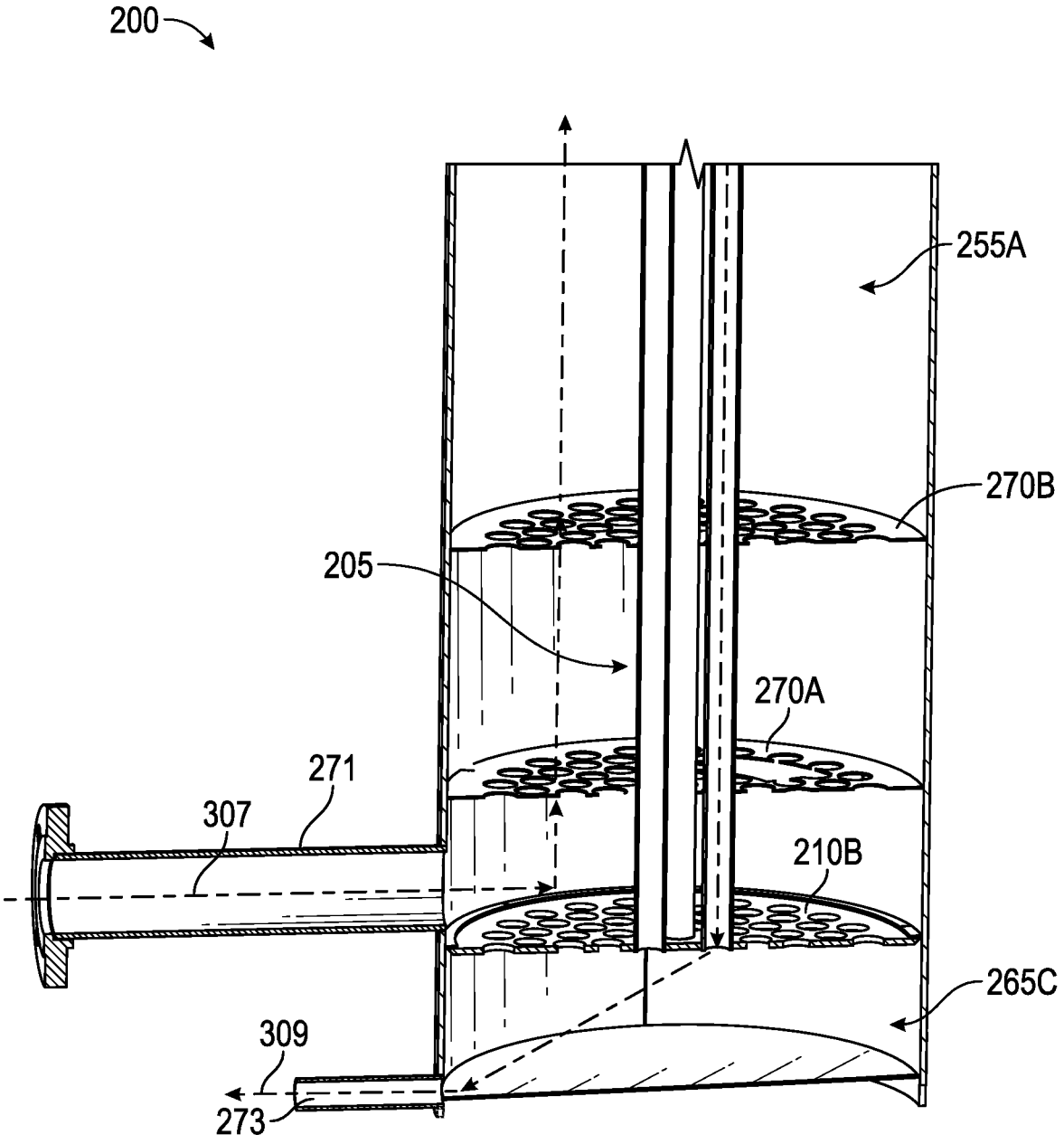
FIGS. 3A and 3B show the flow of fluid and a combusted fuel/air mixture through the thermal transfer device of FIGS. 2A through 2D in accordance with certain example embodiments.
Figure 3B:
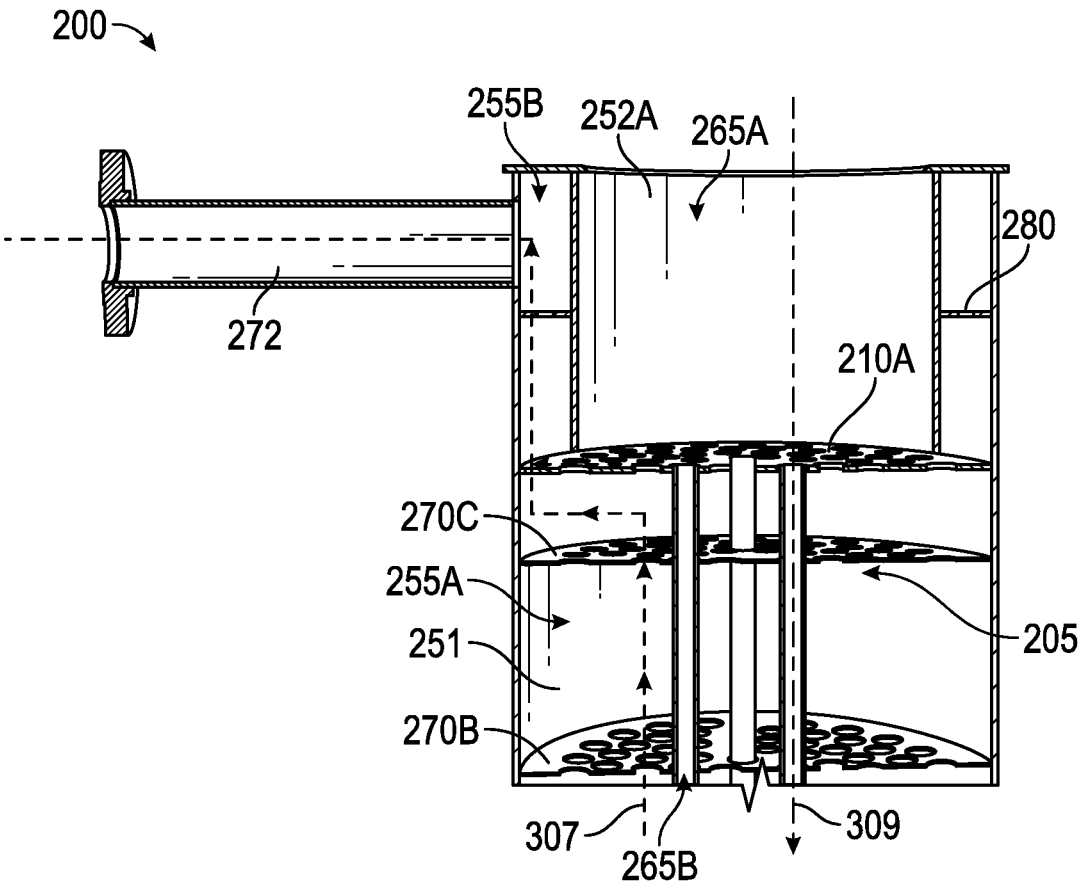

FIGS. 3A and 3B show the flow of fluid 307 and a combusted fuel/air mixture 309 through the thermal transfer device 200 of FIGS. 2A through 2D in accordance with certain example embodiments. Specifically, FIG. 3A shows a cross-sectional side view of the lower half of the thermal transfer device 200. FIG. 3B shows a cross-sectional side view of the upper half of the thermal transfer device 200. Referring to FIGS. 1A through 3B, the combusted fuel/air mixture 309 is introduced to the thermal transfer device 200 at the top flue gas portion 265A. While not shown in FIGS. 1A through 3B, there can be one or more components (e.g., piping, a burner, a blower) that are used to combust the fuel, mix the air, and deliver the combusted fuel/air mixture 309 to the top flue gas portion 265A.

Once inside the top flue gas portion 265A, because of the barrier formed by the tube sheet 210A against the wall 252 and top end of the HX tubes 205, the combusted fuel/air mixture 309 is directed into the cavity 265B of each of the HX tubes 205. As discussed above, as the combusted fuel/air mixture 309 moves down the cavity 265B of the HX tubes 205, heat energy from the combusted fuel/air mixture 309 is transferred to the thermally-conductive wall of the HX tubes 205, thereby heating the thermally-conductive wall of the HX tubes 205.

Afterwards, the combusted fuel/air mixture 309 reaches the bottom of the HX tubes 205, thereby entering the bottom flue gas portion 265C of the thermal transfer device 200. The bottom flue gas portion 265C than continues from the bottom flue gas portion 265C through the pipe 271 to the exhaust vent 275. After the exhaust vent 275, the bottom flue gas portion 265C leaves the thermal transfer device 200, whether to be vented to the atmosphere, used for another process, further processed by another device, or otherwise utilized or disposed. This flow of the combusted fuel/air mixture 309 is continuous, at least for a period of time (e.g., ten minutes, an hour, three days), depending on factors such as the configuration of the thermal transfer device 200 and the demand for the fluid 307 that is heated by the thermal transfer device 200.

The fluid 307 flows in the opposite direction (bottom to top) within the thermal transfer device 200 relative to the combusted fuel/air mixture 309 in this case. Specifically, the fluid 307 enters the inlet 273 and subsequently proceeds to the bottom of the main fluid portion 255A. Once in the main fluid portion 255A, the fluid 307 receives heat held by the thermally-conductive walls of the HX tubes 205 disposed throughout the main fluid portion 255A. Over time, the temperature of the fluid 307 increases as the fluid 307 remains in the main fluid portion 255A.

At some point (e.g., seconds later, hours later, days later) in time after entering the main fluid portion 255A, the fluid 307 is drawn out of the main fluid portion 255A, past the features (e.g., recesses) along the outer perimeter of tube sheet 210A, and into the fluid collection portion 255B. As the fluid 307 is drawn through the fluid collection portion 255B toward the outlet 272, the fluid passes through one or more of the example baffles 280 disposed within the fluid collection portion.

FIG. 4 shows a top view of a tube sheet 210A from the thermal transfer device 200 of FIGS. 2A through 3B. Referring to FIGS. 1A-4, tube sheet 210A of FIG. 4 has a body 415 through which a number of apertures 420 traverse. The body 415 has an outer perimeter 417 that is formed in part by, in this case, a number of equidistantly spaced features 419. Without the features 419, the outer perimeter 417 of the tube sheet 210A would form a circle having a shape and size the substantially matches the shape and size of the inner surface of the wall 251 toward the top of the thermal transfer device 200. In alternative cases, the outer perimeter 417 of the body 415 of the tube sheet 210A can have any of a number of other shapes, including but not limited to a square, an oval, a triangle, a hexagon, a random shape, and an octagon.

The features 419 in this case are step-wise recesses 416 through which fluid (e.g., fluid 307) flows from the main fluid portion 255A to the fluid collection portion 255B. There can also be a small aperture 414 that traverses the body 415 proximate to the outer perimeter 417 inbetween adjacent recesses 416. Each aperture 414 can be used as a coupling feature (e.g., to receive a fastening device (e.g., a rivet, a bolt)) or as another path for fluid (e.g., fluid 307) to flow from the main fluid portion 255A to the fluid collection portion 255B.

The features 419 shown in FIG. 4 are only an example as to the number, size, shape, relative spacing, and configuration of such features 419. While all of the features 419 of FIG. 4 are substantially identical to each other and are spaced equidistantly from each other, in alternative embodiments, one feature 419 can have a different configuration relative to one or more other features 419 of the tube sheet 210A. Also, the number of features 419 and/or spacing between adjacent features 419 can vary.

The tube sheet 210A can have multiple apertures 420 that traverse the body 415. In such a case, as shown in FIG. 4, all of the apertures 420 can have substantially the same size and shape as each other. Alternatively, the size and shape of one aperture 420 can have a different size and/or shape compared to one or more other apertures 420. Such shapes can include, but are not limited to, a circle (as shown in FIG. 4), a square, an oval, and a triangle. Each of the apertures 420 is configured to receive the top end of a HX tube 205.

The body 415 can have a center 413. The apertures 420 that traverse the body 415 of the tube sheet 210A are disposed in an organized manner around the center 413 of the body 415 of the tube sheet 210A. For example, in this case, the apertures 420 are organized in five concentric circles around the center 413, where the apertures 420 are relatively spaced out with respect to each other in each concentric circle. The apertures 420 can be arranged in any of a number of other patterns (e.g., rows and columns, randomly) in alternative embodiments. Each aperture 420 has an outer perimeter 425 (which is part of the body 415) that forms, when viewed from above, a circle having a radius and a center 423.

Figure 9:
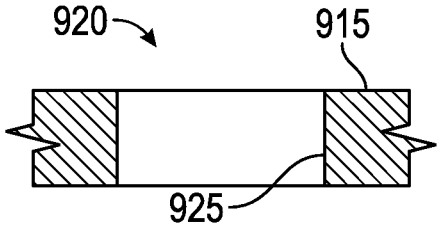
FIGS. 9 through 12 show cross-sectional side views of various apertures in accordance with certain example embodiments.

Due to the functions served by the tube sheet 210A, namely to hold the top end of the HX tubes 205 in place while maintaining a physical barrier between the main fluid portion 255A and the top flue gas portion 265A (thereby preventing the fluid (e.g., fluid 307) from entering the top flue gas portion 265A and preventing the combusted fuel/air mixture (e.g., combusted fuel/air mixture 309) from entering the main fluid portion 255A), the shape and size of each aperture 420 is designed to be substantially the same as the shape and size of the outer surface of the HX tube 205 disposed therein. An example of this arrangement of a HX tube 205 disposed in an aperture 420 of the tube sheet 210A is shown below with respect to FIG. 9.

Figure 6:
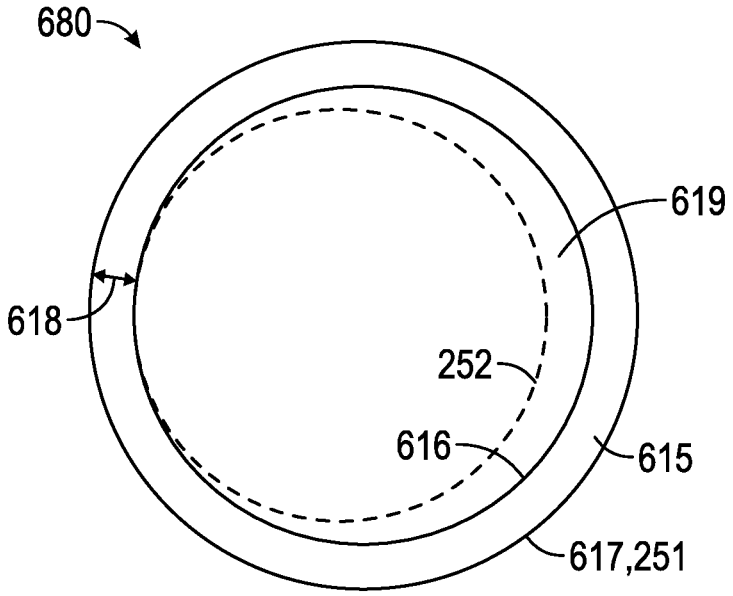
Figure 7:
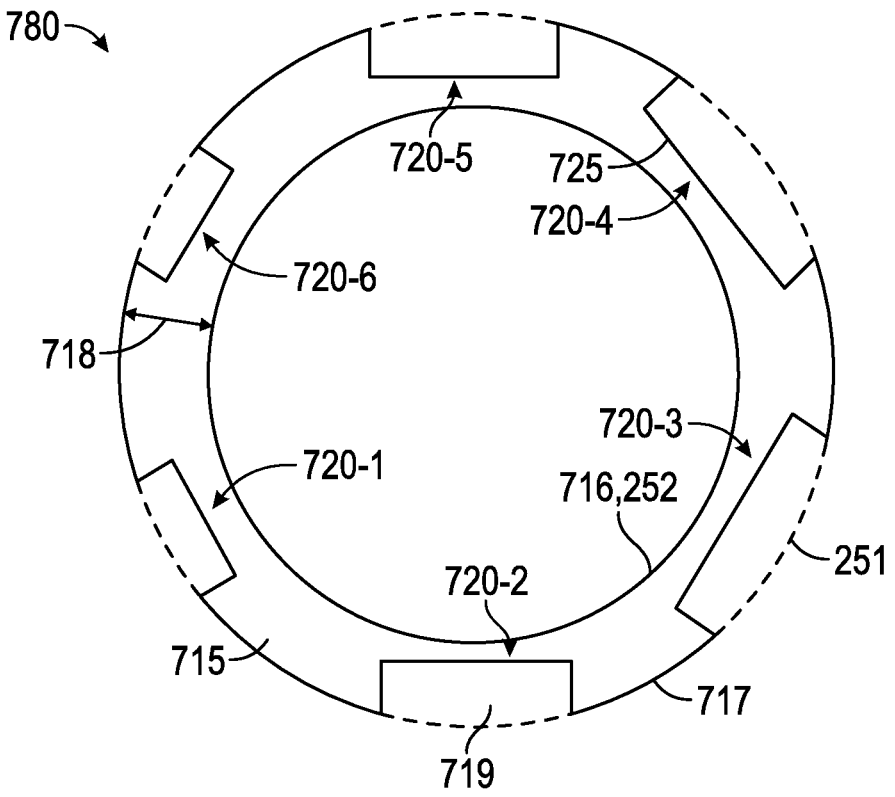
Figure 8:
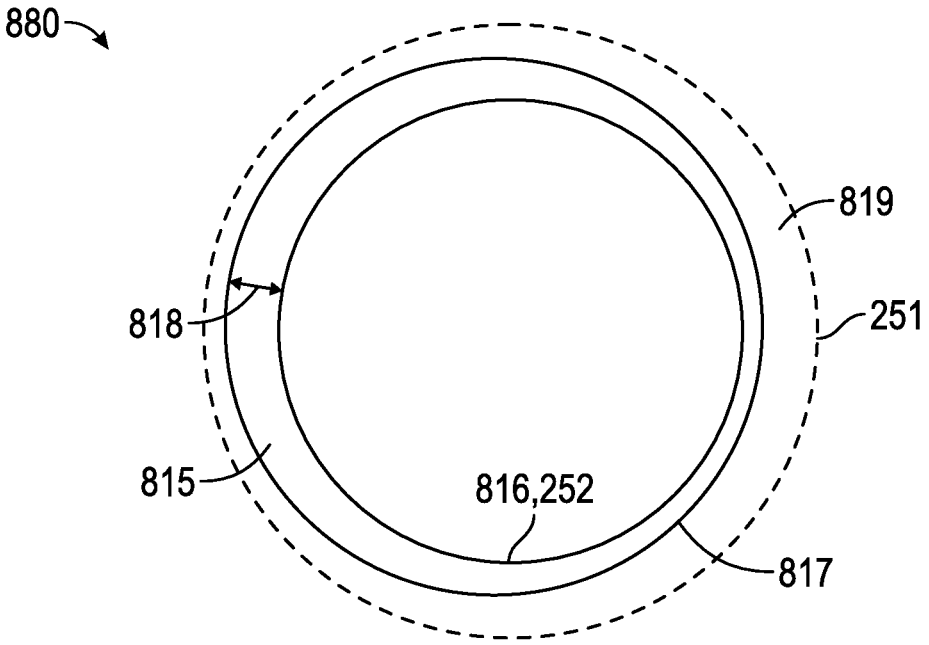

FIGS. 5 through 8 show top views of various example baffles for use in the fluid collection portion of a thermal transfer device in accordance with certain example embodiments. Specifically, FIG. 5 shows an example baffle 580. FIG. 6 shows a top view of an example baffle 680. FIG. 7 shows a top view of an example baffle 780. FIG. 8 shows a top view of an example baffle 880.

Referring to FIGS. 1A through 8, the baffle 580 of FIG. 5 has a body 515 through which a number of apertures 520 traverse. The body 515 has an outer perimeter 517 that forms, in this case, a circle and coincides with the inner surface of the wall 251 of the thermal transfer device 200 (superimposed on the baffle 580 of FIG. 5). In other words, the outer perimeter 517 of the baffle 580 has a shape and size the substantially matches the shape and size of the inner surface of the wall 251 at some location within the fluid collection portion 255B of the thermal transfer device 200. In alternative cases, the outer perimeter 517 of the body 515 of the baffle 580 can have any of a number of other shapes (or portions thereof), including but not limited to a square, an oval, a triangle, a hexagon, a random shape, and an octagon. Such a shape and/or size can differ from the shape and/or size of the inner surface of the wall 251 at some location within the fluid collection portion 255B.

The body 515 also has an inner perimeter 516 that forms, in this case, a circle and coincides with the outer surface of the wall 252 of the thermal transfer device 200 (superimposed on the baffle 580 of FIG. 5). In other words, the inner perimeter 516 of the baffle 580 has a shape and size the substantially matches the shape and size of the outer surface of the wall 252 at some location within the fluid collection portion 255B of the thermal transfer device 200. In alternative cases, the inner perimeter 516 of the body 515 of the baffle 580 can have any of a number of other shapes (or portions thereof), including but not limited to a square, an oval, a triangle, a hexagon, a random shape, and an octagon. Such a shape and/or size can differ from the shape and/or size of the outer surface of the wall 252 at some location within the fluid collection portion 255B. The inner perimeter 516 and the outer perimeter 517 are separated by a distance 518, which in this case is constant around the entire baffle 580. Also, the center 523 of each aperture 520 is located at approximately half the distance 518 between the inner perimeter 516 and the outer perimeter 517.

The baffle 580 can have multiple apertures 520 that traverse the body 515. Each aperture 520 creates a gap 519 through which fluid (e.g., fluid 307) can flow. In this case, there are 16 apertures 520 (aperture 520-1, aperture 520-2, aperture 520-3, aperture 520-4, aperture 520-5, aperture 520-6, aperture 520-7, aperture 520-8, aperture 520-9, aperture 520-10, aperture 520-11, aperture 520-12, aperture 520-13, aperture 520-14, aperture 520-15, and aperture 520-16). In some cases, all of the apertures 520 can have substantially the same size and shape as each other. Alternatively, as shown in FIG. 5, the size and shape of one aperture 520 can have a different size and/or shape compared to one or more other apertures 520. This difference in size of the apertures 520 is the asymmetrical feature that creates the desired pressure drop within the fluid collection portion 255B. Such shapes can include, but are not limited to, a circle (as shown in FIG. 5), a square, an oval, a random shape, a hexagon, and a triangle.

For example, in this case, all of the apertures 520 of the baffle 580 have the same circular shape. The size of the apertures 520, however, varies. Specifically, aperture 520-1, aperture 520-2, and aperture 520-16 have substantially the same size (e.g., diameter, radius) as each other. Also, aperture 520-3, aperture 520-4, aperture 520-5, aperture 520-13, aperture 520-14, and aperture 520-15 have substantially the same size (e.g., diameter, radius) as each other, which his larger than the size of aperture 520-1, aperture 520-2, and aperture 520-16.

Further, aperture 520-6, aperture 520-7, aperture 520-11, and aperture 520-12 have substantially the same size (e.g., diameter, radius) as each other, which his larger than the size of aperture 520-3, aperture 520-4, aperture 520-5, aperture 520-13, aperture 520-14, and aperture 520-15. In addition, aperture 520-8, aperture 520-9, and aperture 520-10 have substantially the same size (e.g., diameter, radius) as each other, which his larger than the size of aperture 520-6, aperture 520-7, aperture 520-11, and aperture 520-12.

The apertures 520 that traverse the body 515 of the baffle 580 can be disposed in an organized manner around the body 515 of the baffle 580. For example, in this case, the apertures 520 are spaced relatively equidistantly relative to each other around the body 515. The apertures 520 can be arranged in any of a number of other patterns (e.g., rows and columns, randomly) in alternative embodiments. Each aperture 520 has an outer perimeter 525 (which is part of the body 515) that forms, when viewed from above, a circle having a radius and a center 523.

In addition to regulating the flow of fluid (e.g., fluid 307) within the fluid collection portion 255B, the example baffle 580 can also help provide structural support for the top part of the thermal transfer device (e.g., thermal transfer device 200). The baffle 580 can be planar. Alternatively, the body 515 of the baffle 580 can formed over three-dimensions (e.g., curved). The thickness of the body 515 of the baffle 580 can be uniform throughout the entirety of the body 515. Alternatively, the thickness of the body 515 can vary.

The orientation of the baffle 580 within the fluid collection portion 255B can vary. For example, the apertures 520 with the smallest diameters (in this case, aperture 520-1, aperture 520-2, and aperture 520-16 centered at or near the approximate 9:00 position) can be located proximate to the outlet 272, which the apertures 520 with the largest diameters (in this case, aperture 520-8, aperture 520-9, and aperture 520-10 centered at or near the approximate 3:00 position) can be located furthest away from the outlet 272. In this way, because of the pressure drop created by this configuration of apertures in the baffle 580 where the pressure is higher near the outlet 272 and lower on the opposite side of the fluid collection portion 255B to bias the flow of fluid toward the outlet 272, more fluid (e.g., fluid 307) can flow through the part of the fluid collection portion 255B (e.g., furthest away from the outlet 272) that tends to be most stagnant to remove or eliminate the stagnancy.

The baffle 680 of FIG. 6 differs from the baffle 580 of FIG. 5 in several ways. First, the baffle 680 has no apertures that traverse its body 615. Second, while the baffle 680 of FIG. 6 has an inner perimeter 616 and an outer perimeter 617, the distance 618 between the inner perimeter 616 and the outer perimeter 617 is not uniform along the body 615. For example, as shown in FIG. 6, the distance 618 is greatest at approximately the 9:00 position, and the distance 618 is smallest at approximately the 3:00 position. Also, there is a gradual increase in the distance 618, substantially equal in both directions (clockwise and counterclockwise), away from the 3:00 position until reaching the 9:00 position. This variation in distance 618 from one side of the baffle 680 to the opposite side of the baffle 680 is the asymmetrical feature that creates the desired pressure drop within the fluid collection portion 255B.

Superimposed on the baffle 680 of FIG. 6 are the outer perimeter of the wall 252 and the inner perimeter of the wall 251 of the thermal transfer device 200 of FIGS. 2A through 2D. The shape and size of the outer perimeter 617 of the baffle 680 is substantially the same as the inner perimeter of the wall 251 of the thermal transfer device 200 of FIGS. 2A through 2D, and so the lines for both coincident. By contrast, the outer perimeter of the wall 252 is smaller than the inner perimeter 616 of the baffle 680. Where the distance 618 is greatest (at the 9:00 position), the outer perimeter of the wall 252 and the inner perimeter 616 of the baffle 680 are coincident. However, in moving toward the 3:00 position, in equal measure between clockwise and counterclockwise travel, there is a gap 619 that gradually increases, eventually maximizing at the 3:00 position. This gap 619 represents where fluid (e.g., fluid 307) travels from one side (e.g., the bottom) of the baffle 680 to the other side (e.g., the top) of the baffle 680.

In this case, the inner perimeter 616 and the outer perimeter 617 of the body 615 of the baffle 680 form approximate circles when viewed from above. In alternative cases, the inner perimeter 616 and/or the outer perimeter 617 of the body 615 of the baffle 680 can have any of a number of other shapes (or portions thereof), including but not limited to a square, an oval, a triangle, a hexagon, a random shape, and an octagon. Such a shape and/or size can differ from the shape and/or size of the outer surface of the wall 252 and/or the inner surface of the wall 251 at some location within the fluid collection portion 255B.

In addition to regulating the flow of fluid (e.g., fluid 307) within the fluid collection portion 255B, the example baffle 680 can also help provide structural support for the top part of the thermal transfer device (e.g., thermal transfer device 200). The baffle 680 can be planar. Alternatively, the body 615 of the baffle 680 can formed over three-dimensions (e.g., curved). The thickness of the body 615 of the baffle 680 can be uniform throughout the entirety of the body 615. Alternatively, the thickness of the body 615 can vary.

The orientation of the baffle 680 within the fluid collection portion 255B can vary. For example, the portion of the baffle 680 where the distance 618 between the the inner perimeter 616 and the outer perimeter 617 of the body 615 is greatest (approximately the 9:00 position in this example) can be located proximate to the outlet 272, and where the portion of the baffle 680 where the distance 618 between the the inner perimeter 616 and the outer perimeter 617 of the body 615 is the least (approximately the 3:00 position in this example) can be located can be located furthest away from the outlet 272. In this way, because of the pressure drop created by this configuration of a gradually changing gap 619 between the inner surface 616 of the baffle 680 and the outer surface of the wall 252 of the thermal transfer device 200 where the pressure is higher near the outlet 272 and lower on the opposite side of the fluid collection portion 255B to bias the flow of fluid toward the outlet 272, more fluid (e.g., fluid 307) can flow through the part of the fluid collection portion 255B (e.g., furthest away from the outlet 272) that tends to be most stagnant to remove or eliminate the stagnancy.

The baffle 780 of FIG. 7 has a body 715 through which a number of apertures 720 traverse. The body 715 has an outer perimeter 717 that forms, in this case, a number of arc segments of a circle, where the arc segments coincide with the inner surface of the wall 251 of the thermal transfer device 200 (superimposed on the baffle 780 of FIG. 7). In other words, the arc segments that form the outer perimeter 717 of the baffle 780 has a shape and size the substantially matches the shape and size of the inner surface of the wall 251 at some location within the fluid collection portion 255B of the thermal transfer device 200. In alternative cases, the outer perimeter 717 of the body 715 of the baffle 780 can have any of a number of other shapes (or segments thereof), including but not limited to a square, an oval, a triangle, a hexagon, a random shape, and an octagon. Such a shape and/or size can differ from the shape and/or size of the inner surface of the wall 251 at some location within the fluid collection portion 255B.

The body 715 also has an inner perimeter 716 that forms, in this case, a circle and coincides with the outer surface of the wall 252 of the thermal transfer device 200 (superimposed on the baffle 780 of FIG. 7). In other words, the inner perimeter 716 of the baffle 780 has a shape and size the substantially matches the shape and size of the outer surface of the wall 252 at some location within the fluid collection portion 255B of the thermal transfer device 200. In alternative cases, the inner perimeter 716 of the body 715 of the baffle 780 can have any of a number of other shapes (or portions thereof), including but not limited to a square, an oval, a triangle, a hexagon, a random shape, and an octagon. Such a shape and/or size can differ from the shape and/or size of the outer surface of the wall 252 at some location within the fluid collection portion 255B. The inner perimeter 716 and the outer perimeter 717 (disregarding the apertures 720) are separated by a distance 718, which in this case is constant around the entire baffle 780.

The baffle 780 can have multiple apertures 720 that traverse the body 715. Each aperture 720 creates a gap 719 through which fluid (e.g., fluid 307) can flow. In this case, there are 6 apertures 720 (aperture 720-1, aperture 720-2, aperture 720-3, aperture 720-4, aperture 720-5, and aperture 720-6). In some cases, all of the apertures 720 can have substantially the same size and shape as each other. Alternatively, as shown in FIG. 7, the size and shape of one aperture 720 can have a different size and/or shape of one or more other apertures 720. This difference in size of the apertures 720 is the asymmetrical feature that creates the desired pressure drop within the fluid collection portion 255B. Such shapes (or portions thereof) can include, but are not limited to, a circle, a rectangle (or portion thereof, as shown in FIG. 7), an oval, a random shape, a hexagon, and a triangle.

For example, in this case, all of the apertures 720 of the baffle 780 have the same rectangular shape. The size of the apertures 720, however, varies. Specifically, aperture 720-1 and aperture 720-6 have substantially the same size (e.g., width, height) as each other. Also, aperture 720-2 and aperture 720-5 have substantially the same size (e.g., width, height) as each other, which his larger than the size of aperture 720-1 and aperture 720-6. Further, aperture 720-3 and aperture 720-4 have substantially the same size (e.g., width, height) as each other, which his larger than the size of aperture 720-2 and aperture 720-5.

The apertures 720 that traverse the body 715 of the baffle 780 can be disposed in an organized manner around the body 515 of the baffle 780. For example, in this case, the apertures 720 are spaced relatively equidistantly relative to each other around the body 715. Specifically, aperture 720-1 is located at approximately the 8:00 position, aperture 720-2 is located at approximately the 6:00 position, aperture 720-3 is located at approximately the 4:00 position, aperture 720-4 is located at approximately the 2:00 position, aperture 720-5 is located at approximately the 12:00 position, and aperture 720-6 is located at approximately the 10:00 position. The apertures 720 can be arranged in any of a number of other locations (e.g., additionally or alternatively located along the inner perimeter 716) and/or patterns (e.g., rows and columns, randomly) in alternative embodiments. Each aperture 720 has an outer perimeter 725 (which is part of the body 515) that forms, when viewed from above, a segment of a rectangle.

In addition to regulating the flow of fluid (e.g., fluid 307) within the fluid collection portion 255B, the example baffle 780 can also help provide structural support for the top part of the thermal transfer device (e.g., thermal transfer device 200). The baffle 780 can be planar. Alternatively, the body 715 of the baffle 780 can formed over three-dimensions (e.g., curved). The thickness of the body 715 of the baffle 780 can be uniform throughout the entirety of the body 715. Alternatively, the thickness of the body 715 can vary.

The orientation of the baffle 780 within the fluid collection portion 255B can vary. For example, the apertures 720 with the smallest diameters (in this case, aperture 720-1 and aperture 720-6 centered around the approximate 9:00 position) can be located proximate to the outlet 272, and the apertures 720 with the largest diameters (in this case, aperture 720-3 and aperture 720-4 centered around the approximate 3:00 position) can be located furthest away from the outlet 272. In this way, because of the pressure drop created by this configuration of apertures in the baffle 780 where the pressure is higher near the outlet 272 and lower on the opposite side of the fluid collection portion 255B to bias the flow of fluid toward the outlet 272, more fluid (e.g., fluid 307) can flow through the part of the fluid collection portion 255B (e.g., furthest away from the outlet 272) that tends to be most stagnant to remove or eliminate the stagnancy.

The baffle 880 of FIG. 8 has some similarities to the baffle 680 of FIG. 6 but is configured to be coupled to the outer surface of the wall 252, as opposed to the inner surface of the wall 251, of the thermal transfer device 200. The baffle 880 has no apertures that traverse its body 815. Further, while the baffle 880 of FIG. 8 has an inner perimeter 816 and an outer perimeter 817, the distance 818 between the inner perimeter 816 and the outer perimeter 817 is not uniform along the body 815. For example, as shown in FIG. 8, the distance 818 is greatest at approximately the 9:00 position, and the distance 818 is smallest at approximately the 3:00 position. Also, there is a gradual increase in the distance 818, substantially equal in both directions (clockwise and counterclockwise), away from the 3:00 position until reaching the 9:00 position. This variation in distance 818 from one side of the baffle 880 to the opposite side of the baffle 880 is the asymmetrical feature that creates the desired pressure drop within the fluid collection portion 255B.

Superimposed on the baffle 880 of FIG. 8 are the outer perimeter of the wall 252 and the inner perimeter of the wall 251 of the thermal transfer device 200 of FIGS. 2A through 2D. The shape and size of the inner perimeter 816 of the baffle 880 is substantially the same as the outer perimeter of the wall 252 of the thermal transfer device 200 of FIGS. 2A through 2D, and so the lines for both coincident. By contrast, the inner perimeter of the wall 251 is larger than the outer perimeter 817 of the baffle 880, forming a gap 819. In this case, the gap varies but is always present at all points between the inner perimeter of the wall 251 is larger than the outer perimeter 817 of the baffle 880.

Where the distance 818 is greatest (at the 9:00 position), the gap 819 between the inner perimeter of the wall 251 and the outer perimeter 817 of the baffle 880 is at a minimum. However, in moving toward the 3:00 position, in equal measure between clockwise and counterclockwise travel, the gap 819 between the inner perimeter of the wall 251 and the outer perimeter 817 of the baffle 880 gradually increases, eventually maximizing at the 3:00 position. This gap 819 represents where fluid (e.g., fluid 307) travels from one side (e.g., the bottom) of the baffle 880 to the other side (e.g., the top) of the baffle 880.

In this case, the inner perimeter 816 and the outer perimeter 817 of the body 815 of the baffle 880 form approximate circles when viewed from above. In alternative cases, the inner perimeter 816 and/or the outer perimeter 817 of the body 815 of the baffle 880 can have any of a number of other shapes (or portions thereof), including but not limited to a square, an oval, a triangle, a hexagon, a random shape, and an octagon. Such a shape and/or size can differ from the shape and/or size of the outer surface of the wall 252 and/or the inner surface of the wall 251 at some location within the fluid collection portion 255B.

In addition to regulating the flow of fluid (e.g., fluid 307) within the fluid collection portion 255B, the example baffle 880 can also help provide structural support for the top part of the thermal transfer device (e.g., thermal transfer device 200). The baffle 880 can be planar. Alternatively, the body 815 of the baffle 880 can formed over three-dimensions (e.g., curved). The thickness of the body 815 of the baffle 880 can be uniform throughout the entirety of the body 815. Alternatively, the thickness of the body 815 can vary. In this case, since the baffle 880 does not make any direct contact with the inner surface of wall 251 of the outer surface of wall 252, the baffle 880 can be disposed within the fluid collection portion 255B using one or more of a number of indirect coupling features (e.g., brackets).

The orientation of the baffle 880 within the fluid collection portion 255B can vary. For example, the portion of the baffle 880 where the distance 818 between the the inner perimeter 816 and the outer perimeter 817 of the body 815 is greatest (approximately the 9:00 position in this example) can be located proximate to the outlet 272, and where the portion of the baffle 880 where the distance 818 between the the inner perimeter 816 and the outer perimeter 817 of the body 815 is the least (approximately the 3:00 position in this example) can be located can be located furthest away from the outlet 272. In this way, because of the pressure drop created by this configuration of a gradually changing gap 819 between the outer surface 817 of the baffle 880 and the inner surface of the wall 251 of the thermal transfer device 200 where the pressure is higher near the outlet 272 and lower on the opposite side of the fluid collection portion 255B to bias the flow of fluid toward the outlet 272, more fluid (e.g., fluid 307) can flow through the part of the fluid collection portion 255B (e.g., furthest away from the outlet 272) that tends to be most stagnant to remove or eliminate the stagnancy.

Figure 10:
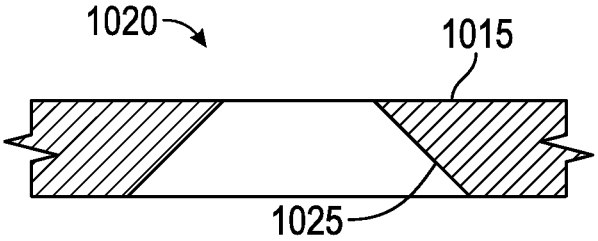

FIGS. 9 through 12 show cross-sectional side views of various apertures (e.g., aperture 520, aperture 720) in accordance with certain example embodiments. Referring to FIGS. 1A through 12, FIG. 9 shows a cross-sectional side view of an aperture 920 that traverses the body 915 of an example baffle (e.g., baffle 280), where the outer perimeter 925 is a wall that is substantially perpendicular to the top surface and the bottom surface of the body 915 of the baffle. FIG. 10 shows a cross-sectional side view of an aperture 1020 that traverses the body 1015 of an example baffle (e.g., baffle 280), where the outer perimeter 1025 is a wall that is slanted away from the top surface toward the bottom surface of the body 1015 of the baffle, so that the size (in this case, a diameter) of the aperture 1020 is larger at the bottom than it is at the top.

Figure 11:
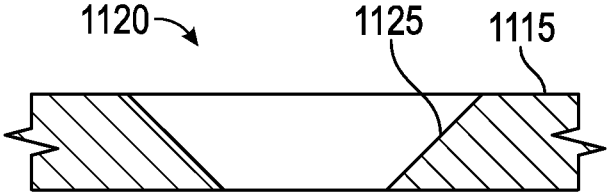
Figure 12:
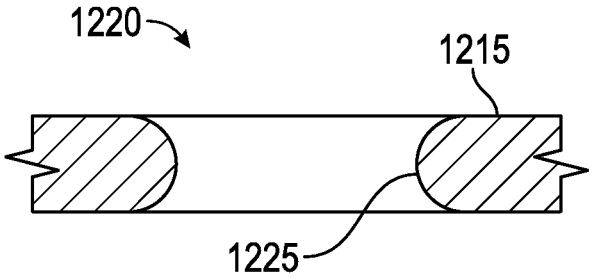

FIG. 11 shows a cross-sectional side view of an aperture 1120 that traverses the body 1115 of an example baffle (e.g., baffle 280), where the outer perimeter 1125 is a wall that is slanted away from the bottom surface toward the top surface of the body 1115 of the baffle, so that the size (in this case, a diameter) of the aperture 1120 is larger at the top than it is at the bottom. FIG. 12 shows a cross-sectional side view of an aperture 1220 that traverses the body 1215 of an example baffle (e.g., baffle 280), where the outer perimeter 1225 is a wall that forms an outwardly-facing (into the aperture 1220) semicircle between the top surface and the bottom surface of the body 1215 of the baffle. While the embodiments shown in FIGS. 9 through 12 are directed to apertures in a baffle, the teachings of FIGS. 9 through 12 can also apply to the inner surface, the outer surface, and/or any other aspect of an example baffle.

Example embodiments described herein allow for flexible and more efficient designs for thermal transfer devices (e.g., condensing boilers, heat exchangers, water heaters) in which example baffles can be used. Example embodiments can be used to improve the flow of fluid through thermal transfer devices where such fluids absorb thermal energy (e.g., heat, cold) for use in another process. Specifically, example embodiments can be used to improve the flow of heated fluid within a fluid collection portion of a thermal transfer device. Example embodiments can be customizable with respect to any of a number of characteristics (e.g., shape, size, aperture configuration, aperture locations, protrusions). Further, the shape, size, and other characteristics of an example baffle can be specifically configured for a particular thermal transfer device. Example embodiments can be mass produced or made as a custom order.

Some thermal transfer devices can include multiple example baffles, which can each be configured (e.g., location, size, number of apertures) the same as or differently relative to each other. Such configurations can increase thermal efficiency relative to the current art. Further, such configurations of baffles can significantly lower the metal temperature at targeted locations of the thermal transfer device. Further, the number of example baffles and the location of the baffles relative to each other are novel features in the art that promote increased thermal efficiency, increased mechanical stability, improved fluid flow, and increased durability over the current art.

The various configurations, including aperture size, number of apertures, asymmetric baffle designs, and single/multiple relatively larger aperture variations, of example baffles described herein can help make the flow pattern of the fluid in the thermal transfer device more uniform. Such configurations of the example baffles also reduce the temperature of the walls, baffles, tube sheets, and other materials within the thermal transfer device, thereby increasing the durability of the thermal transfer device. Example embodiments can also be used in environments that require compliance with one or more standards and/or regulations.

Accordingly, many modifications and other embodiments set forth herein will come to mind to one skilled in the art to which example baffles pertain having the benefit of the teachings presented in the foregoing descriptions and the associated drawings. Therefore, it is to be understood that baffles are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A baffle for a fluid collection portion of a thermal transfer device, wherein the baffle comprises:

a body comprising an inner perimeter, an outer perimeter, and one or more asymmetric features, each of the one or more asymmetric features being configured to create a pressure drop within the fluid collection portion of the thermal transfer device, wherein the inner perimeter is configured to be at least as large as a perimeter of an outer surface of a first wall that forms the fluid collection portion of the thermal transfer device, wherein the outer perimeter is configured to be no larger than a perimeter of an inner surface of a second wall that forms the fluid collection portion of the thermal transfer device, and wherein one of the one or more asymmetric features comprises a plurality of apertures disposed at a plurality of locations along the body, at least one of the plurality of apertures having a size that is different from a size of another of the plurality of apertures.

2. The baffle of claim 1, wherein at least one of the one or more asymmetric features starts at a first side of the body and ends at a second side of the body, wherein the first side and the second side are opposite each other.

3. The baffle of claim 2, wherein the first side of the body is configured to be located proximate an outlet of the thermal transfer device.

4. The baffle of claim 2, wherein the second side of the body is configured to be located proximate an outlet of the thermal transfer device.

5. The baffle of claim 1, wherein the plurality of apertures are located on the body between the inner perimeter and the outer perimeter.

6. The baffle of claim 1, wherein at least one the plurality of apertures overlaps the inner perimeter.

7. The baffle of claim 1, wherein at least one the plurality of apertures overlaps the outer perimeter.

8. The baffle of claim 2, wherein another of the one or more asymmetric features comprises a difference in a distance between the inner perimeter and the outer perimeter.

9. The baffle of claim 1, wherein the body is planar.

10. The baffle of claim 1, wherein another of the one or more asymmetric features comprises a curvature to the body.

11. A fluid collection portion of a thermal transfer device, wherein the fluid collection portion comprises:

a first wall having an outer surface;

a second wall having an inner surface;

an outlet; and a first baffle disposed between the first wall and the second wall, wherein the first baffle comprises a first baffle body having:

a first inner perimeter that is at least as large as a perimeter of the outer surface of the first wall;

a first outer perimeter that is approximately equal in size to the perimeter of the inner surface of the second wall; and a first asymmetric feature comprising a plurality of apertures disposed at a plurality of locations along the body, at least one of the plurality of apertures having a size that is different from a size of another of the plurality of apertures, wherein the first asymmetric feature is configured to create a pressure drop within the fluid collection portion of the thermal transfer device, wherein the pressure drop forces fluid proximate to the first baffle to traverse toward the outlet.

12. The fluid collection portion of claim 11, wherein the first baffle is directly coupled to the outer surface of the first wall.

13. The fluid collection portion of claim 11, wherein the first baffle abuts against the outer surface of the first wall.

14. The fluid collection portion of claim 11, wherein the first baffle is directly coupled to the inner surface of the second wall.

15. The fluid collection portion of claim 11, wherein the first baffle abuts against the inner surface of the second wall.

16. The fluid collection portion of claim 11, wherein the first asymmetric feature comprises at least one gap through which fluid flows.

17. The fluid collection portion of claim 11, further comprising:

a second baffle disposed between the first wall and the second wall, wherein the second baffle comprises a second baffle body having a second inner perimeter and a second outer perimeter.

18. The fluid collection portion of claim 17, wherein the second baffle further comprises the first asymmetric feature.

19. The fluid collection portion of claim 17, wherein the second baffle further comprises a second asymmetric feature that is different from the first asymmetric feature.

* * * * *